US005240183A

United States Patent [19]

Bedaw et al.

[11] Patent Number: 5,240,183

[45] Date of Patent: Aug. 31, 1993

[54] ATOMIZING SPRAY NOZZLE FOR MIXING A LIQUID WITH A GAS

[75] Inventors: Robert E. Bedaw, Turners Falls; William F. Walker, South Deerfield, both of Mass.

[73] Assignee: Bete Fog Nozzle, Inc., Greenfield, Mass.

[21] Appl. No.: 711,211

[22] Filed: Jun. 6, 1991

[51] Int. Cl.[5] ..... B05B 7/04

[52] U.S. Cl. ..... 239/403; 239/432; 239/491; 239/501

[58] Field of Search ..... 239/403, 432, 472, 487, 239/491, 501

[56] References Cited

U.S. PATENT DOCUMENTS

| | | | |
|---|---|---|---|
| 391,865 | 10/1888 | Schutte | 239/472 |
| 1,549,537 | 8/1925 | Hansen | 239/501 |
| 1,686,846 | 10/1928 | Everhart | 239/403 |
| 2,804,341 | 8/1957 | Bete | 239/501 |
| 4,456,181 | 6/1984 | Burnham | 239/501 X |
| 4,514,291 | 4/1985 | McGarry et al. | 239/501 X |
| 4,972,995 | 11/1990 | Schara et al. | 239/432 X |
| 5,072,883 | 12/1991 | Vidusek | 239/403 X |
| 5,108,583 | 4/1992 | Keon | 239/501 X |

FOREIGN PATENT DOCUMENTS

| | | | |
|---|---|---|---|
| 963945 | 7/1950 | France | 239/403 |
| 1219149 | 3/1986 | U.S.S.R. | 239/501 |

*Primary Examiner*—Andres Kashnikow
*Assistant Examiner*—William Grant
*Attorney, Agent, or Firm*—Chapin, Neal & Dempsey, P.C.

[57] ABSTRACT

Atomizing spray nozzle for mixing and atomizing various liquid and gas combinations includes a central liquid conduit, an annular gas passage disposed concentrically about the liquid conduit, a helical spray member and a spray head. The spray member includes a bore disposed in axial alignment with the liquid conduit and is of helical configuration which, in cross-section, tapers inwardly toward the distal end thereof. The spray head is of generally tubular configuration and encloses the helical member, except for at least one outlet orifice through its outer end wall. The spray head provides a chamber for the mixing of the gas and liquid and for the discharge of the resulting mixture through the orifice of the head to form an atomized spray.

9 Claims, 2 Drawing Sheets

ATOMIZING SPRAY NOZZLE FOR MIXING A LIQUID WITH A GAS

BACKGROUND OF THE INVENTION

This invention relates to liquid gas mixing nozzles for generating fine sprays and, more particularly, to nozzles developed for atomization of the liquid phase.

In the past, various nozzle structures have been employed for mixing a liquid and gas internally of the nozzle by imparting a whirling motion to the mixture, as shown in Pat. Nos. 738,131 to Weaver and Pat. No. 893,833 to Beckman. For many applications, such internal mixing nozzles have been found unsuitable, such as when used for spraying abrasive slurries due to the abrasive wear on the nozzle body. To overcome this problem, an external mixing nozzle for the gas and liquid was devised. One such nozzle is shown in Pat. No. 4,456,181 to Burnham, assigned to Bete Fog Nozzle, Inc., assignee of the present application.

Among the disadvantages of external mixing are the incomplete mixing of the gas and liquid with resulting liquid droplets being of relatively larger size than are acceptable for certain applications in which very fine particle size is essential, such as in cooling, humidification, spray drying, pollution control spraying and catalytic cracking of crude oil.

Accordingly, the principal object of this invention is to provide an atomizing spray nozzle constructed to achieve more complete mixing of various gas and liquid combinations and which produces more uniform mixing of the liquid and gas phases and generates finer spray droplets than were heretofore available.

Another object of this invention is to provide a nozzle of the above type which is capable of producing an atomized spray in which the average droplet size will be within the $10\mu$–$500\mu$ range and which has more uniform performance characteristics than the spray nozzles heretofore available.

A further object of this invention is to provide spray nozzles of the above type, characterized by abrasive resistant components which are especially adapted for combining various liquids with various gases, including crude oil with steam and abrasive slurries with compressed air.

The above and other objects and advantages of this invention will be more readily apparent from the following description read in conjunction with the accompanying drawings in which.

Figure 1:
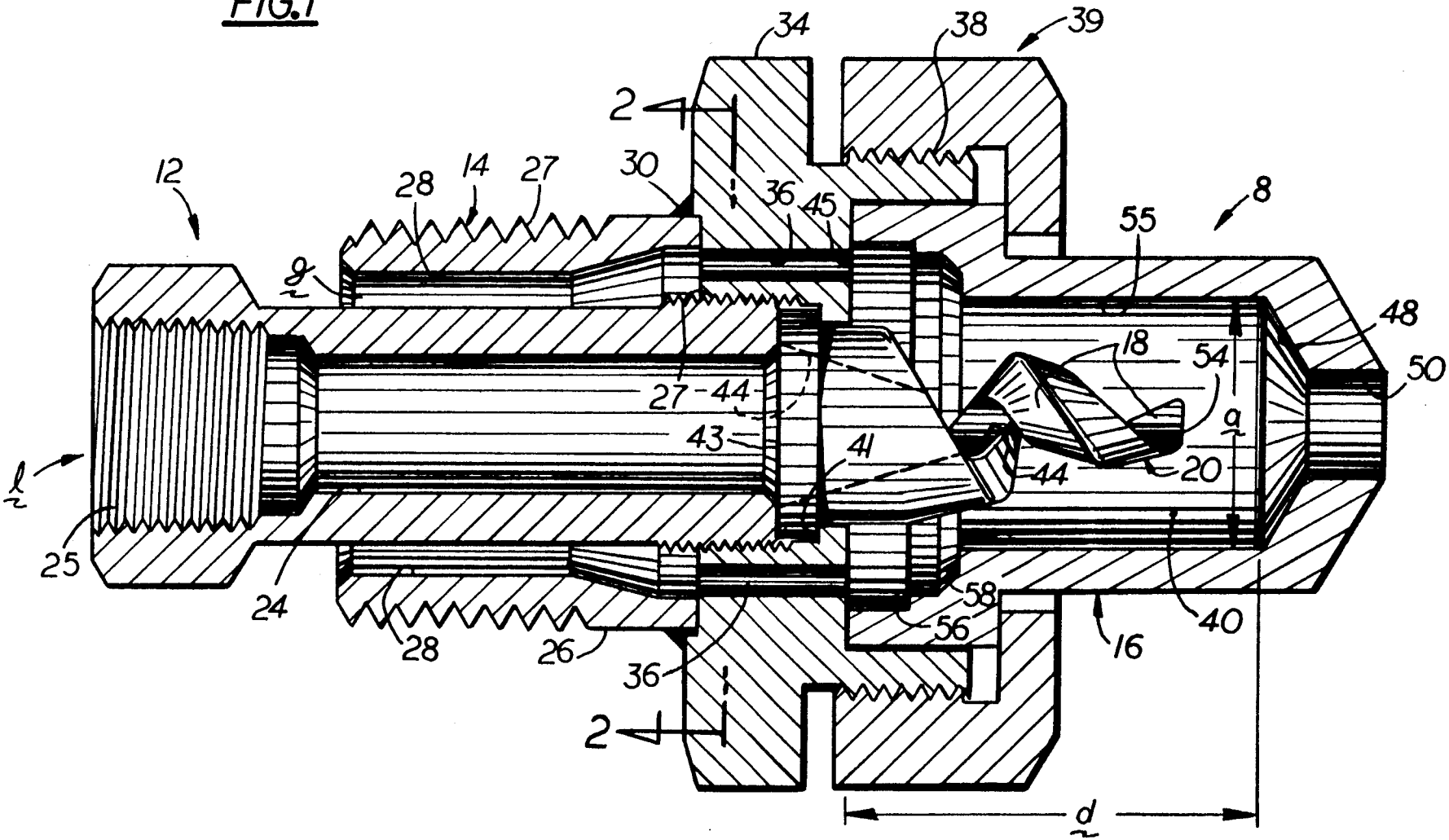
FIG. 1 is a side elevational view in cross-section showing a nozzle of the type embodying this invention.

Depicted in FIG. 1 is an improved gas/liquid mixing nozzle 8 having a generally cylindrical shaped body and comprising a liquid input conduit 12, a gas input conduit 14 and a spray head 16 which is coaxially disposed about a helical vane or spray member 20 which controls the spray pattern of the liquid emitted therefrom.

The liquid input conduit 12 of the nozzle has an axial bore 24 and it is threaded internally at its outer end and externally at its inner end, as at 25 and 27, respectively. The internally threaded portion of the tube 12 is adapted to receive the outer end of an externally threaded pipe for supplying liquid 1 into the bore 24 of the tube 12 under pressure of 10 to 150 psi.

Figure 2:
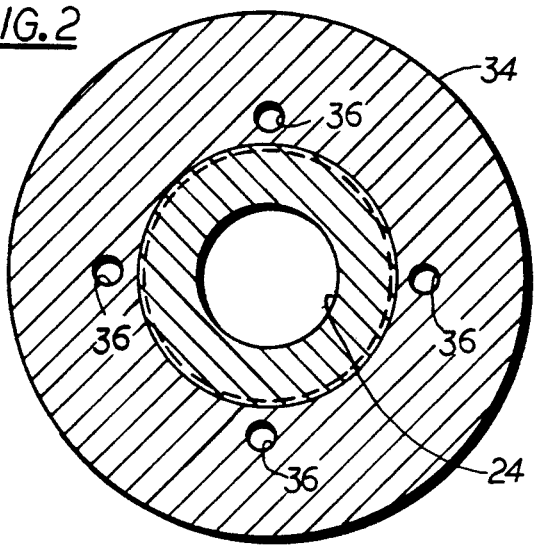
FIG. 2 is a section taken along line 2—2 of FIG. 1.
Figure 3:
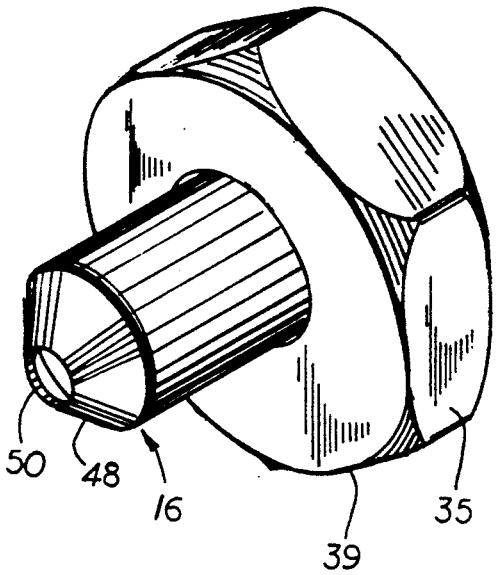
FIG. 3 is a perspective view of the outer tip of the spray head.

As shown, the gas conduit 14 may be a tubular member of larger inner diameter disposed concentrically about the bore 24 to provide an annular passage 28 into which a gas g such as compressed air, pressured steam or the like, may be supplied under pressure of 10 to 150 psi by any suitable means, such as by a pipe fitted onto the tube 26 which is externally threaded, as at 27. The forward or outlet-end 26 of the tubular member 11 is secured, as by welding 30 to an internally and externally threaded coupling or fitting 34. As shown in FIGS. 1 and 2, fitting 34 has a plurality of circumferentially-spaced gas passages 36 which are adapted to receive the pressurized gas flowing through the annular chamber 28 of the tubular member 26 and direct the high velocity gas into the spray head 16. It will be recognized that the compressed gas rather than being fed through a plurality of circumferentially-spaced ports or bores 36 could be fed through a unitary or plurality of annular slots (not shown) into the mixing chamber of the spray head. The forward end of the fitting 34 includes an externally threaded neck portion 38 adapted to be screwfitted within the internally threaded nut-like fastener 39. The fastener 39 is provided to secure the spray head 16 about the helical member 20 which, in turn, is held in place by an inwardly extending shoulder 11 which engages an outwardly extending flange 43 at the inner and/or base of the helical member 20. When the liquid input conduit tube 12 is tightened sufficiently, it will clamp the base of the helical member in sealing relation with the outer end of the bore 24 to provide for leakproof liquid flow from the bore 24 into the bore 44 of the helical member. Fitting 31 and fastener 39 are each provided with hexagonal outer surfaces, as depicted at 35 in FIG. 3, for driving engagement with a wrench for tightening and loosening fastener 39 to facilitate replacement of helical member 20 and spray head 16.

The spray head 16 is of generally cylindrical construction and provides a mixing chamber 10 about the helical member 20. Since these nozzles are especially adapted to be used with abrasive or caustic slurries, the helical member 20 and head 16 are preferably fabricated of a material having a high abrasion resistance, such as stellite, stainless steel, or other special alloy or ceramic. These discrete components, i.e., the helical member 20 and spray head 16, can be readily assembled with the other nozzle components, and in the event of erosion to the spray forming surface of the nozzle, they can be readily removed and refinished or replaced with another part without the necessity of replacing the entire nozzle. The mixing chamber includes an "open" inner end 45 having stepped diameters, a generally cylindrical medial portion 55 and conically tapered or spherically shaped outer end portion 48. The spray head includes two cylindrical tubular portions at the inner ends of which form shoulders 56 and 58 which disrupt the laminar gas flow as it enters the chamber 40 from the gas passages 36 whereby the high velocity gas becomes turbulent for enhanced mixing with the liquid in chamber 10 and the atomization of the liquid phase.

Figure 4:
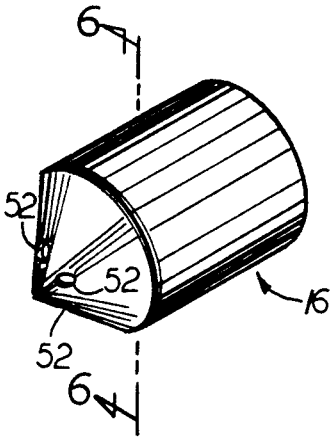
FIGS. 4 and 5 show alternate orifice patterns of the spray head.

Depending on the application of the nozzle, the outer end wall 48 will be provided with one or more outlet orifices and in FIG. 1, orifice 50 is disposed in axial alignment with the axis of the helical member 20. In a preferred embodiment, as best illustrated in FIG. 4, a plurality of orifices 52 are arranged in a circular array about the longitudinal axis of the nozzle.

Figure 5:
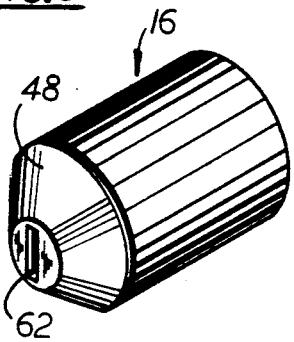
Figure 6:
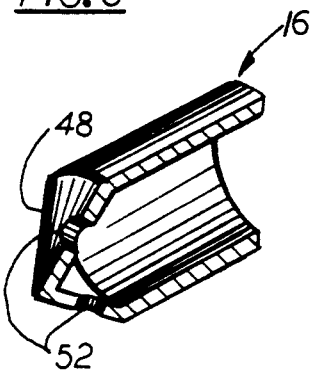
FIG. 6 is cross-sectional view taken along line 6—6 of FIG. 4.
Figure 7:
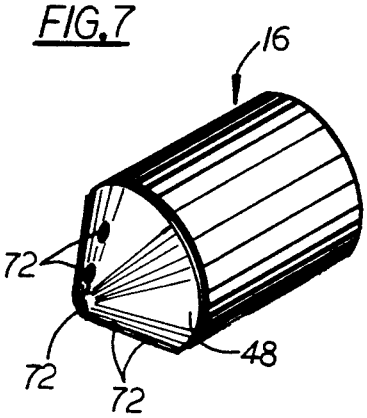
FIG. 7 is a perspective view of another alternative embodiment of the orifice pattern of the spray head embodying the invention.

For proper operation of the nozzle, it is important that the inner diameter a of the cylindrical portion 55 of the spray head 16 be substantially greater than the maximum outer diameter of the helical member 20. It is also important that the helical member terminate at a distance from the orifice 50 approximately equal to the radius of the cylindrical portion of the spray head. It has also been found that the ratio of the length of the spray head d, as shown in FIG. 1, to inner diameter a of the spray head 16 should be approximately 1.5 to 1.7. Further, the ratio of the diameter of the orifice 50 to the diameter a of the mixing chamber should be approximately 0.4. Thus, the cross-sectional area of the spray orifices is approximately 20% of the cross-sectional area of the mixing chamber. The various orifice embodiments depicted at 52 in FIGS. 4 and 6, the slot at 62 in FIG. 5, and aligned orifices at 72 in FIG. 7, are sized to obtain a total outlet orifice area of approximately 20% of the cross-sectional area of the spray head 16 which is generally the same as for the orifice 50 shown in FIG. 3.

The helical member 20 includes at least one helical turns up to as many as two and one-half turns from its inner to its outer end and the pitch of the helix is about ½ to 3 turns per inch.

OPERATION

As liquid under pressure is fed through the bore 24 of tube 12 and flows into the tapered bore 44 of the helical element 20 where the liquid is deflected outwardly by the upstream surfaces 18 of the helical member into a thin conical sheet. Simultaneously compressed gas being supplied into annular passage 28 and which flows through bores 36, will enter the mixing chamber 40 and at high velocity and in a turbulent state, impacts with the liquid spray.

In the mixing chamber, the turbulent and high velocity expanding gas emanating from the holes 36 intersects the thin conical sheet of liquid emitted from the surfaces 18 of helical member 20. This action causes the liquid to be atomized by and mixed with the expanding gas. As the liquid and the ga mixture is impelled through the length of the mixing chamber 10, further mixing and atomization occurs as it advances toward the orifice 50. Prior to it transisting through and emission from the orifice 50, the pressurized gas/air mixture is further accelerated by being funneled inwardly by tapered venturi-like surfaces 48 and the orifice 50, where it rapidly expands as it exits the orifice 50 to ambient or atmospheric pressure, causes further atomization of the mixture.

It has been found that this nozzle construction will produce very fine liquid sprays in which the average droplet size may vary, depending on the flow ratio from 10μ to 500μ.

Having thus described my invention, what is claimed is:

1. A nozzle for mixing a liquid with a gas, the nozzle comprising a flow passage for the liquid, a helical member extending outwardly of said liquid flow passage and having at least one turn of predetermined outermost diameter, a flow passage of the gas, and a spray head disposed about said helical member, said spray head comprising a mixing chamber having an open inner end to receive the gas, an outer end wall having an orifice thererethrough, said mixing chamber having a cylindrical inner portion of a predetermined length, an inner diameter and an inner conical surface extending from said cylindrical inner portion to said outer end wall, at least one shoulder disposed in said mixing chamber to cause turbulence of the gas, the inner diameter of said chamber being substantially smaller than the length of the cylindrical portion thereof such that the ratio of said length to said diameter is substantially within the range of 1.5 to 1.7.

2. The nozzle for mixing a liquid with a gas of claim 1, wherein said orifice is disposed in axial alignment with said helical member.

3. The nozzle for mixing a liquid with a gas of claim 16, wherein said orifice comprises a plurality of orifices disposed concentrically about the longitudinal axis of the helical member.

4. The nozzle for mixing a liquid with a gas of claim 1, wherein the flow passage for the gas comprises a plurality of circumferentially-spaced axially extending bores communicating with the interior of the spray head.

5. The nozzle for mixing a liquid with a gas of claim 1, wherein the orifice comprises at least one axially extending opening spaced radially outwardly of said liquid flow passage on a predetermined annular circumference defined by said radial spacing, said opening communicating with the interior of said spray head.

6. The nozzle for mixing a liquid with a gas of claim 1, wherein said at least one shoulder includes at least two sections of different diameter which induce said turbulence.

7. The nozzle for mixing a liquid with a gas of claim 1, wherein said inner diameter of said cylindrical portion is substantially greater than said outside diameter of said helical member.

8. The nozzle for mixing a liquid with a gas of claim 1, wherein the relation of the diameter of said end wall orifice to said inner diameter of said cylindrical portion is approximately 0.4.

9. The nozzle for mixing a liquid with a gas of claim 1, wherein said helical member terminates at a distance from said end wall orifice which is approximately equal to the radius of said cylindrical portion.

* * * * *